US006992648B2

(12) United States Patent
Yamada

(10) Patent No.: US 6,992,648 B2
(45) Date of Patent: Jan. 31, 2006

(54) BRIGHTNESS ADJUSTING APPARATUS OF REFLECTIVE TYPE LIQUID CRYSTAL DISPLAY DEVICE AND PROGRAM OF GAME MACHINE

(75) Inventor: Yoichi Yamada, Kyoto (JP)

(73) Assignee: Nintendo Co., Ltd., Kyoto (JP)

( * ) Notice: Subject to any disclaimer, the term of this patent is extended or adjusted under 35 U.S.C. 154(b) by 276 days.

(21) Appl. No.: 10/214,639

(22) Filed: Aug. 9, 2002

(65) Prior Publication Data

US 2003/0030610 A1 Feb. 13, 2003

(30) Foreign Application Priority Data

Aug. 10, 2001 (JP) ..... 2001-244245

(51) Int. Cl.
*G09G 3/36* (2006.01)

(52) U.S. Cl. ..... 345/88; 345/102

(58) Field of Classification Search ..... 345/88, 345/87, 426, 600, 113, 63, 77, 102, 147; 463/43

See application file for complete search history.

(56) References Cited

U.S. PATENT DOCUMENTS 5,598,516 A * 1/1997 Mori ..... 345/426
5,650,832 A * 7/1997 Poradish et al. ..... 348/743
5,933,130 A * 8/1999 Wagner ..... 345/690
6,005,636 A 12/1999 Westerman
6,023,261 A * 2/2000 Ugajin ..... 345/634
6,094,185 A 7/2000 Shirriff
6,322,447 B1 * 11/2001 Okada et al. ..... 463/31
6,628,255 B1 * 9/2003 Ferrel et al. ..... 345/88
6,665,173 B2 * 12/2003 Brandenberg et al. ..... 361/680

FOREIGN PATENT DOCUMENTS

EP 0 869 473 10/1998
JP 8-241067 9/1996

* cited by examiner

*Primary Examiner*—Albert De Cady
*Assistant Examiner*—Fritz Alphonse
(74) *Attorney, Agent, or Firm*—Nixon & Vanderhye, P.C.

(57) ABSTRACT

A brightness adjusting apparatus of a reflective type liquid crystal display device is applicable to a portable game machine, for example. The portable game machine is provided with a reflective type color liquid crystal display device, and displayed colors of a game character and a background are determined on the basis of color data included in color palettes. When a player inputs an instruction for brightness adjustment, a brightness adjusting screen is displayed in response thereto, and the color data included in each of an OBJ color palette and a BG color palette is converted on the basis of an adjustment value (parameter) corresponding to designated brightness, and then, the brightness of the object and the brightness of the background are individually adjusted.

30 Claims, 11 Drawing Sheets

BRIGHTNESS ADJUSTING APPARATUS OF REFLECTIVE TYPE LIQUID CRYSTAL DISPLAY DEVICE AND PROGRAM OF GAME MACHINE

BACKGROUND

1. Field

The technology described herein relates to a brightness adjusting apparatus of a reflective type liquid crystal display device and a program of a game machine. More specifically, the technology described herein relates to a brightness adjusting apparatus of a reflective type liquid crystal display device and a program of a game machine, applicable to a portable terminal such as a portable type liquid crystal game machine, a PDA and etc.

2. Description of related Art

One example of such a kind of conventional reflective type liquid crystal display device is disclosed in a Japanese patent No. 8-241067 [G09G 5/06, G06T 1/00, G06T 11/00] laid-open on Sep. 17, 1996. In a video accelerator board device of this reference, a true color code determined by a vectorial sum of respective elements of R (red), G (green) and B (blue) is converted by using a correction coefficient matrix, and deviance between a color determined by the true color code and a displayed color actually displayed on the display is corrected.

In a case of controlling display of the reflective type liquid crystal display device utilizing the video accelerator board device of this reference, it is possible to adjust a displayed color on a display as described above. In general, the portable game machine and etc. provided with the reflective type liquid crystal display device is utilized indoors and outdoors, illuminated in a light of a fluorescent and a natural light such as sunlight etc. Accordingly, brightness is determined depending on a usage environment. A brightness adjusting function is thus not provided. However, there is a problem that in intensive sunlight the screen of the reflective type liquid crystal device wholly becomes bright while in weak sunlight it wholly becomes dark. The character (object) is therefore hidden under the background and it is difficult for the user to view the screen.

Even if a brightness adjusting function is provided for avoiding this problem, a mere brightness adjustment as in a liquid crystal display of a backlight system makes a whole screen light or dark and therefore, the problem is not yet solved.

SUMMARY OF EXEMPLARY NON-LIMITING EMBODIMENTS.

Therefore, one aspect of exemplary non-limiting embodiments is to provide a novel brightness adjusting apparatus of a reflective type liquid crystal display device and a program of a game machine.

Another aspect of exemplary non-limiting embodiments is to provide a brightness adjusting apparatus of a reflective type liquid crystal display device and a program of a game machine, capable of adjusting brightness according to a usage environment.

An apparatus according to one exemplary non-limiting embodiment is a brightness adjusting apparatus of a reflective type liquid crystal display device (a reference numeral of a component corresponding thereto in the embodiment: 14) for determining a displayed color on the basis of color data of a color palette, comprising: a character color palette (OBJ palette in the embodiment) for storing a plurality of first color data to display a character (object: OBJ); a background color palette (BG palette in the embodiment) for storing a plurality of second color data to display a background (BG); a brightness determining means (S25, S35, S57, and S67 in the embodiment) for determining brightness of at least one of the character and the background; and a renewal means (S31, S41, S63, and S73 in the embodiment) for renewing at least one of the character color palette and the background color palette on the basis of an adjustment value (OBJ brightness adjusting parameter and/or BG brightness parameter in the embodiment) corresponding to the brightness determined by the brightness determining means.

The brightness adjusting apparatus according to exemplary non-limiting embodiments is applicable to a portable type game machine, for example. Such the portable type game machine is provided with a reflective type color liquid crystal display device, and a displayed color of the character (object: OBJ) such as a game character and the background (BG) is determined on the basis of the color data included in the color palette. The brightness adjusting apparatus is provided with the character color palette and the background color palette. The character color palette is provided with the plurality of first color data to display various characters while the background color palette is provided with the plurality of second color data to display various backgrounds. For example, if and when a user such as a player inputs an instruction for adjusting brightness, a screen for brightness adjustment (brightness adjusting screen) is displayed in response thereto. When the user specifies (selects) the brightness on the brightness adjusting screen, the brightness of the screen (character and background) is determined by the determining means. Thereupon, the renewal means adjusts (converts) the first color data and the second color data with the adjustment value depending on the determined brightness so as to renew at least one of the character color palette and the background color palette. That is, since the color palette according to the brightness designated by the user is utilized, it is possible to display a screen with the displayed color according to the brightness.

For example, a first determining means determines the brightness of the character, and therefore, a first renewal means can convert (adjust) the first color data with a first adjustment value corresponding to the brightness so as to renew the character color palette. That is, it is possible to adjust the brightness of the character (object) image.

Furthermore, a second determining means determines the brightness of the background, and therefore, a second renewal means can convert (adjust) the second color data with a second adjustment value corresponding to the brightness so as to renew the background color palette. It is possible to adjust the brightness of the background image.

In addition, both of the first determining means and the second determining means are provided as well as the first renewal means and the second renewal means and whereby, it is also possible to individually adjust the brightness of the character image and the background image.

Also, the first adjustment value and the second adjustment value are determined to be different values even with the same brightness, and therefore, it is possible to prevent the character from being hidden under the background and the user from viewing the screen with difficulty.

Furthermore, if a detecting means for detecting first color data and second color data corresponding to a specified color, e.g., white or black is provided, the first renewal means and the second renewal means can renew the color palette by converting color data except for the first color data and the second color data. For example, when displaying cosmos, night, letters or the like, in a case that black becomes gray, the view of the world of the game is changed. On the other hand, when displaying letters, a white background or the like, in a case that white becomes gray, the view of the world of the game is changed as well. Thus, if black or white is turned to another color, change of the view of the world and difficulty of view occur and therefore, the black or white is intended not to be converted. However, in a case where blue, red or another color has a great importance during the game, blue, red or another color may not be intended to be converted.

For example, the adjustment value is determined on the basis of a gradation characteristic of a color on the reflective type color liquid crystal display device. For example, three primary colors (R, G and B) have different reflection ratios, and in view of this, the adjustment value is determined. Accordingly, it is possible to make a brightness adjustment taking advantage of a characteristic of the reflective type color liquid crystal display device.

In one aspect, an apparatus is a brightness adjusting apparatus of a reflective type liquid crystal display device (a reference numeral of a component corresponding thereto in the embodiment: 14) for determining a displayed color on the basis of color data of a color palette, comprising: a brightness determining means (S25, S35, S57 and S67 in the embodiment) for determining brightness; a detecting means (S29, S39, S61 and S71 in the embodiment) for detecting color data corresponding to a specified color; and a renewal means (S31, S41, S63 and S73 in the embodiment) for renewing a color palette (OBJ palette and BG palette in the embodiment) by converting the color data except for color data corresponding to a specified color with an adjustment value (OBJ brightness adjusting parameter and BG brightness adjusting parameter in the embodiment) corresponding to the brightness determined by the brightness determining means (S25, S35, S57 and S67 in the embodiment).

Also in this embodiment, the brightness adjusting apparatus of the reflective type liquid crystal display device is applicable to a portable type game machine, for example. Such the portable game machine is provided with a reflective type color liquid crystal display apparatus, and the displayed color of the character such as a game character or the background is determined on the basis of the color data included in the color palette. In the brightness adjusting apparatus, when a user such as a player inputs an instruction for adjusting brightness, a screen for brightness adjustment is displayed in response thereto. If and when the user specifies (selects) the brightness on the brightness adjusting screen, the brightness of the screen such as the character, background and etc. is determined by the determining means. Thereupon, the color data is adjusted (converted) with an adjustment value corresponding to the determined brightness so as to renew the color palette by the renewal means. It is noted that in a case that the detecting means detects the color data corresponding to the specified color such as white, black or the like, color data except for that color data is renewed by the renewal means. That is, it is possible to determine the displayed color of the character or the background by utilizing the color palette corresponding to the brightness designated by the user. Furthermore, since the brightness adjustment is not performed on white or black, it is possible to prevent whitish or blackish display on the whole screen.

For example, the color palette includes the character color palette including a plurality of first color data to display various characters, and the first renewal means converts (adjusts) the first color data included in the character color palette with the first adjustment value corresponding to the determined brightness so as to renew the character color palette. That is, it is possible to adjust the brightness of the character image (object). It is noted that the first renewal means does not convert the color data corresponding to a specified color such as white or black.

Furthermore, the color palette includes a background color palette including a plurality of second color data to display various backgrounds, and the second renewal means converts the second color data included in the background color palette with the second adjustment value corresponding to the determined brightness so as to renew the background color palette. That is, it is possible to adjust the brightness of the background image. It is noted that the second renewal means does not convert the color data corresponding to the specified color such as white or black.

Thus, since the character color palette and the background color palette are individually prepared, it is possible to determine a displayed color and brightness adjustment of the character and the background, respectively. Furthermore, if the first adjustment value and the second adjustment value are different from each other in values even with the same brightness, the character is never hidden under the background.

Another exemplary non-limiting embodiment is directed to a program for a game machine (a reference numeral of a component corresponding thereto in this embodiment: 10) provided with a game program (game program stored in the ROM 60 in the embodiment) executed by a processor so as to allow a character and a background to be displayed on a reflective type liquid crystal display device (a reference numeral of a component corresponding thereto in this embodiment: 14) by utilizing a character color palette storing a plurality of first color data and a background color palette for storing a plurality of second color data (OBJ palette and BG palette in the embodiment). Then, the program makes the processor execute following steps: a display step (a brightness adjusting screen display program stored in the ROM 60 in the embodiment) for displaying a brightness adjusting screen (70); and a renewal step (a brightness adjustment program in the embodiment and equal to steps S31, S41, S63, and S73) for renewing at least one of the character color palette and the background color palette on the basis of an adjustment value (OBJ brightness adjusting parameter and BG brightens adjustment parameter in the embodiment) corresponding to the brightness of at least one of the character and the background determined on the brightness adjusting screen.

This program is, for example, provided with the character color palette storing the plurality of first color data to display the character on the reflective type liquid crystal display device and the background color palette storing the plurality of second color data to display the background on the reflective type liquid crystal display device. Also, the program for the game machine is provided with the display program to display the brightness adjusting screen and displays the brightness adjusting screen according to an instruction of the user such as a game player. Then, the renewal program renews at least one of the character color palette and the background color palette on the basis of the adjustment value corresponding to the brightness of at least one of the character and the background determined on the brightness adjusting screen. Accordingly, it is possible to display a game screen with the displayed color according to the brightness designated by the user.

Similarly, a further program is provided with a program for a game machine (a reference numeral of a component corresponding thereto in this embodiment: 10) including a game program (game program stored in the ROM 60 in the embodiment) for determining a displayed color of a reflective type liquid crystal display device (a reference numeral of a component corresponding thereto in this embodiment: 14) so as to execute a game utilizing a color palette storing a plurality of color data by a processor, a game program makes the processor execute following steps: a display step (a brightness adjusting screen display program stored in the ROM 60 in the embodiment) for displaying a brightness adjusting screen (70); a detecting step (a brightness adjustment program stored in the ROM 60 in the embodiment and equal to steps S29, S39, S61, and S71) for detecting the color data corresponding to a specified color; and a renewal step (a brightness adjustment program in the embodiment and equal to steps S31, S41, S63, and S73) for renewing the color palette by converting the color data except for the color data corresponding to the specified color with an adjustment value (an OBJ brightness adjusting parameter and a BG brightness adjusting parameter in the embodiment) corresponding to the brightness determined by the brightness adjusting screen.

Such the program is provided with the color palette storing a plurality of color data to determine the displayed color of the reflective type liquid crystal display device. The display program displays the brightness adjusting screen according to the instruction of the user such as a player of the game. Accordingly, the user can adjust (determine) the brightness of the screen on the brightness adjusting screen. Then, the renewal program converts the color data on the basis of the adjustment value corresponding to the brightness determined by the brightness adjusting screen so as to renew the color palette. It is noted that when the detecting program detects the color data corresponding to a specified color such as white or black, the renewal program does not convert the color data corresponding to white or black. That is, the renewal program renews the color palette by converting the color data except for the color data corresponding to white or black. Accordingly, it is possible to display the screen of the game according to the brightness designated by the user, and furthermore, as described above, it is possible to avoid a disadvantage occurring in a case of adjusting the brightness of the specified color.

According to exemplary non-limiting embodiments, it is possible to display the screen with the brightness designated by the user, and therefore, it is possible to make the user easy to view the screen irrespective of brightness of natural light. That is, it is possible to adjust brightness according to a usage environment.

The above described objects and other objects, features, aspects and advantages of exemplary non-limiting embodiments will become more apparent from the following detailed description of exemplary non-limiting embodiments when taken in conjunction with the accompanying drawings.

DETAILED DESCRIPTION OF EXEMPLARY NON-LIMITING EMBODIMENTS.

Figure 1:
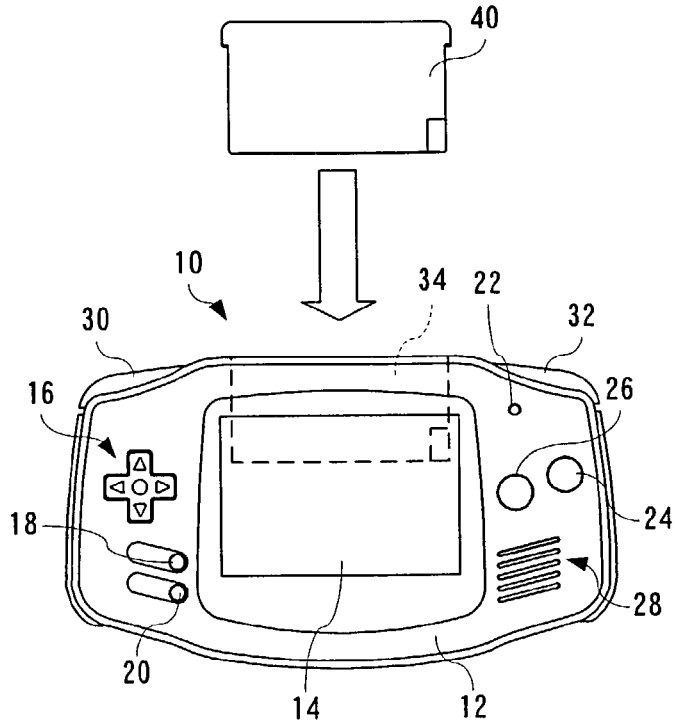
FIG. 1 is an illustrative view showing one exemplary non-limiting embodiment.

Referring to FIG. 1, a brightness adjusting apparatus of a reflective type liquid crystal display device of this embodiment is a portable type color liquid crystal game machine (hereinafter, may be referred to as "game machine") 10, and the game machine 10 includes a housing (case) 12. A reflective type color liquid crystal display device (hereinafter, may simply be referred to as "LCD") 14 is provided at the approximately center of the case 12. At the left of the LCD 14, a cross button 16 is provided, and a start button 18 and a selection button 20 are provided below the cross button 16.

The LCD 14 is a dot-matrix display device and utilized for color-displaying a game character image (object image) and a background image. Furthermore, the cross button 16 is utilized for instructing the game character displayed on the LCD 14 to move in right to left or up and down, upper right, upper left, lower right and lower left directions. The start button 18 is utilized for instructing a start, pause, and restart of a game. The selection button 20 is utilized for selecting a game mode and etc.

An LED (power source lamp) 22 is provided at the upper right of the LCD 14. Two push buttons (an A button 24 and a B button 26 in this embodiment) are provided below the LED 22, and a speaker 28 is provided thereunder.

The LED 22 indicates a power-on or power-off state by blink of it and a remaining amount of a battery by a color of an emitted light. The A button 24 and the B button 26 are utilized for instructing the movement (action) of the game character. For example, the buttons allow the character to use an arm, to run, or to jump. The speaker 28 is utilized for outputting a BGM, and sound of the game character, sound effects and etc. during the game.

The case 12 is provided with a left push button (L button) 30 and a right push button (R button) 32 on its upper (top) surface. The L button 30 and the R button 32 are utilized for instructing action of the game character similar to the A button 24 and the B button 26.

An insertion slot 34 is provided between the L button 30 and the R button 32 on the top surface of the case 12 and on the back of the above-described LCD 14. A memory cartridge 40 is inserted from the insertion slot 34 to be loaded onto the game machine main body 10.

It is noted that although an illustration is omitted, the case 12 is provided with an external expansion connector on its upper surface and a battery housing box on its back surface, and a power switch, sound volume, earphone jack and etc. on its bottom surface.

Figure 2:
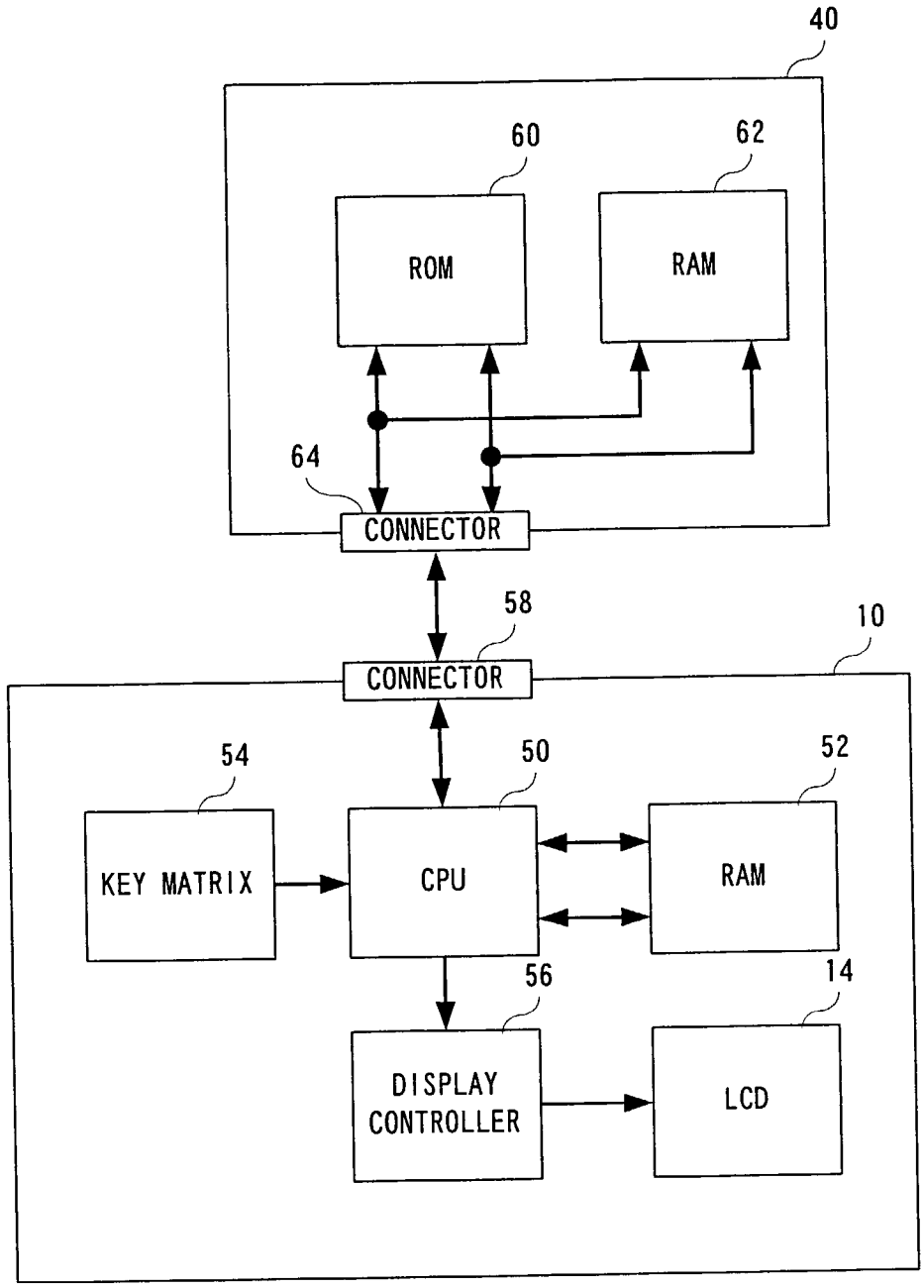
FIG. 2 is a block diagram showing structure of a game machine and a memory cartridge shown in FIG. 1 embodiment.

A detailed configuration of such the game machine 10 and the memory cartridge 40 is shown in FIG. 2. The game machine 10 includes a CPU 50 connected with a RAM 52 and a key matrix 54 through an internal bus. The RAM 52 is utilized as a working memory of the CPU 50 or a buffer memory. Although an illustration is omitted, the key matrix 54 is connected with the cross button 16, the start button 18, the selection button 20, the A button 24, the B button 26, the L button 30, the R button 32 and etc. shown in FIG. 1. When these buttons (16 to 20, 24, 26, 30 and 32) are operated, the key matrix 54 generates an operation signal corresponding to an operated button so as to input to the CPU 50.

Furthermore, the CPU 50 is connected with the LCD 14 via an internal bus and a display control device (driver) 56 and connected with a connector 58 via an internal bus. It is noted that the connector 58 is omitted in FIG. 1.

On the other hand, the memory cartridge 40 includes a ROM 60 and a RAM 62 which are connected with each other via an internal bus and are connected to a connector 64. It is noted that the connector 64 is omitted in FIG. 1.

Specifically, when the memory cartridge 40 is loaded into the game machine 10, the CPU 50 is connected to the ROM 60 and the RAM 62 within the memory cartridge 40. The ROM 60 is stored with a program such as a game program and etc. required for the game, image data, sound data and etc. as described later in detail. The RAM 62 is, for example, an SRAM for storing backup data of the game.

Figure 3:
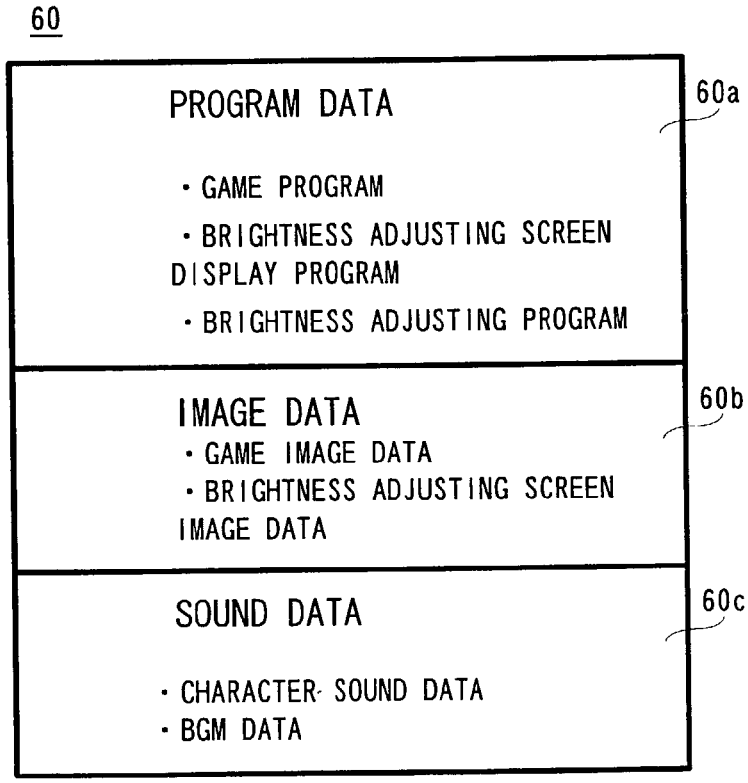
FIG. 3 is an illustrative view showing a memory map of a ROM included in the memory cartridge shown in FIG. 2.

Referring to FIG. 3, the ROM 60 is stored with program data 60*a*, image data 60*b* and sound data 60*c* in advance. The program data 60*a* is constructed, for example, by a game program, a brightness adjusting screen display program and a brightness adjusting program. Furthermore, the image data 60*b* is constructed by game image data (including character image data) and brightness adjusting screen data. In addition, the sound data 60*c* is constructed by character sound data and BGM data.

Figure 4:
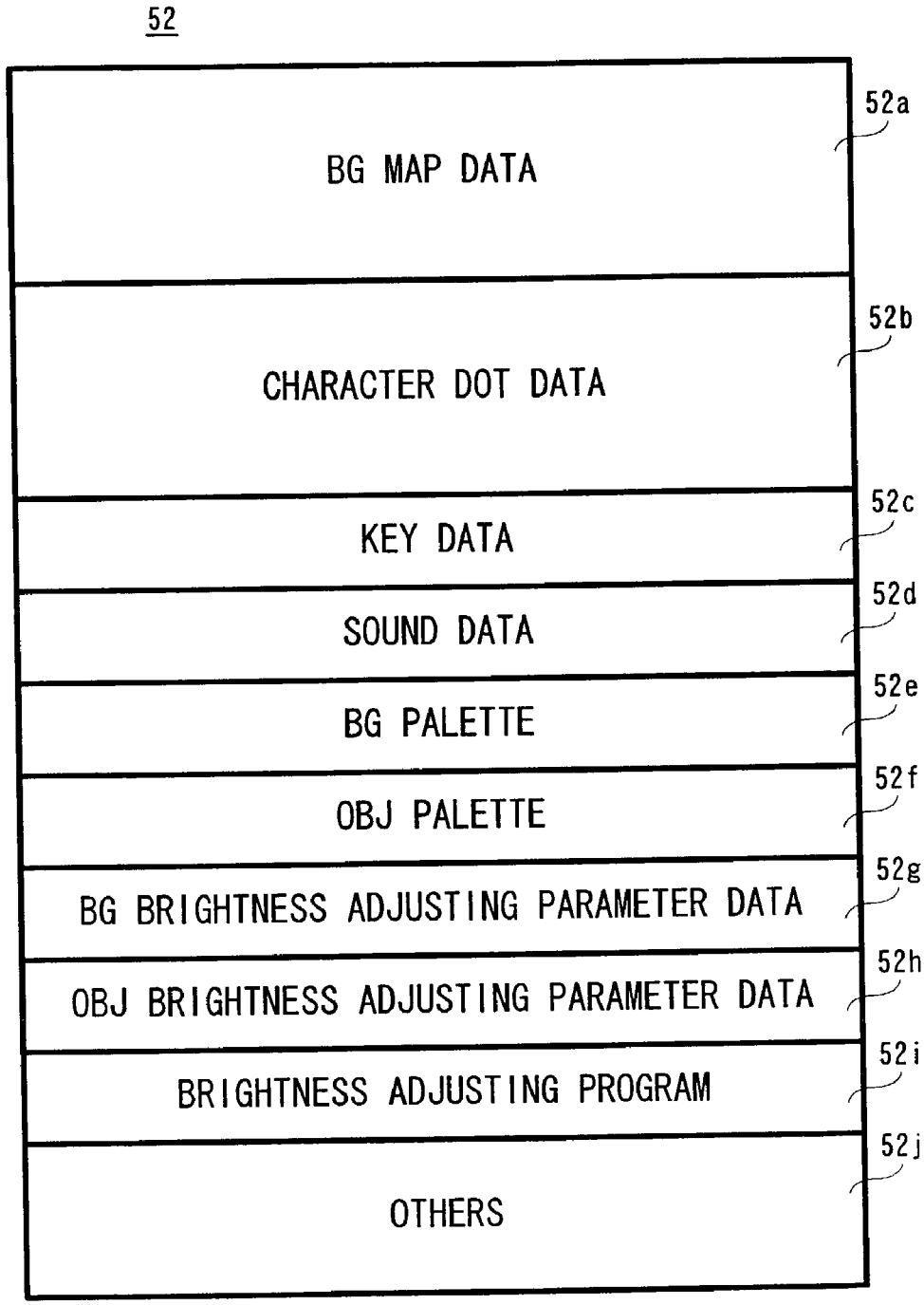
FIG. 4 is an illustrative view showing a memory map of a RAM included in the game machine shown in FIG. 2.

The RAM 52 is provided with a plurality of data areas (hereinafter, may simply be referred to as "area") 52*a* to 52*j*, and a memory map thereof is as shown in FIG. 4. Specifically, background (BG) map data is mapped in the area 52*a*, character dot data is mapped in the area 52*b*, and key data is mapped in the area 52*c*.

It is noted that the BG map data and the character dot data are data included in the game image data of the image data 60*b* stored in the above-described ROM 60.

The sound data 60*c* stored in the above-described ROM 60, i.e., the character sound data and the BGM data are mapped in the area 52*d*, and a color palette (OBJ palette) for object (OBJ) character is mapped in the area 52*e*, and a color palette (BG palette) for BG is mapped in the area 52*f*.

Furthermore, BG brightness adjusting parameter data is mapped in the area 52*g*, OBJ brightness adjusting parameter data is mapped in the area 52*h*, and a brightness adjusting program is mapped in the area 52*i*. In addition, the RAM 52 is provided with another area 52*j*.

The BG map data is data of a character code (code corresponding to character data described later) for BG image display. The character data is bit map data of 8×8 dots and stored in plural (e.g., tens of thousands). Accordingly, by combining these bit map data, all BG image and OBJ image to be displayed on the game can be represented.

The key data is data (table data) indicative of instruction contents corresponding to an operation signal input from the key matrix 54. The sound data is data corresponding to the BGM, or the sound, or the sound effects of the game character all being outputted during the game.

The BG palette is stored with data of three primary colors (R (red), G (green), B (blue)) (hereinafter, may be referred to as "BG color data") corresponding to a plurality of colors to be used for the BG image. Similarly, the OBJ palette is stored with R, G and B data (hereinafter, may be referred to as "OBJ color data") corresponding to a plurality of colors to be used for the OBJ image.

Figure 5:
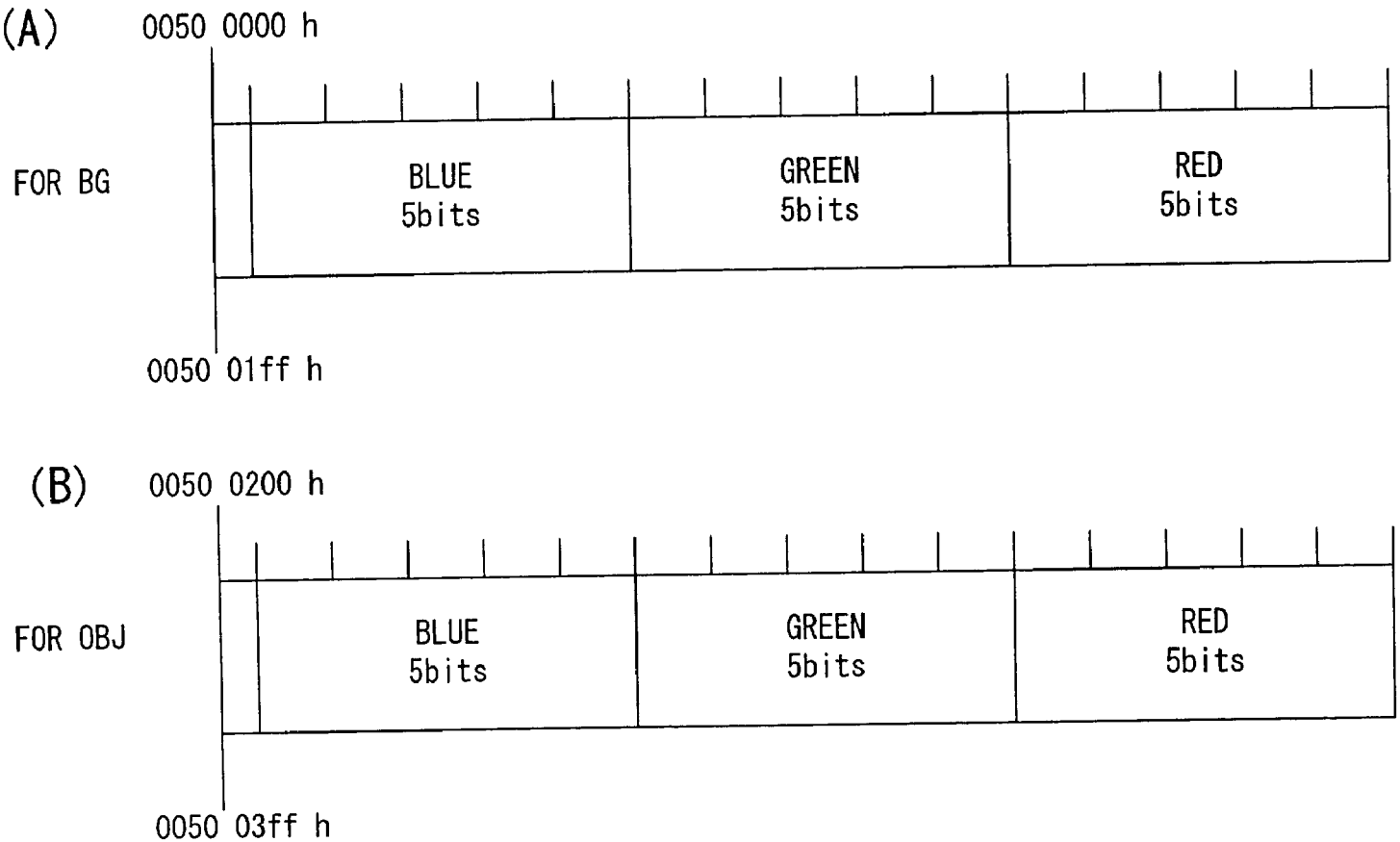
FIG. 5 is an illustrative view showing a BG palette and an OBJ palette on the memory map shown in FIG. 4.

As shown in FIG. 5(A), the BG palette is stored in the area 52*f*, i.e., an address space "0500 0000 h"~"0500 01ff h" of the CPU 50, and each of R, G and B is data of 5 bits. As shown in FIG. 5(B), the OBJ palette is stored in the area 52*g*, i.e., an address space "0500 0200 h"~"0500 03ff h" of the CPU 50, and each of the R, G and B is data of 5 bits.

As the BG brightness adjusting parameter data, brightness adjusting values (parameters) of a plurality of BG color data stored in the above-described BG palette are stored. Specifically, the parameter data corresponding to brightness (luminance) of the BG image are written in a table. Similarly, as the OBJ brightness adjusting parameter data, parameter data corresponding to brightness of the OBJ image are written in a table.

Figure 6:
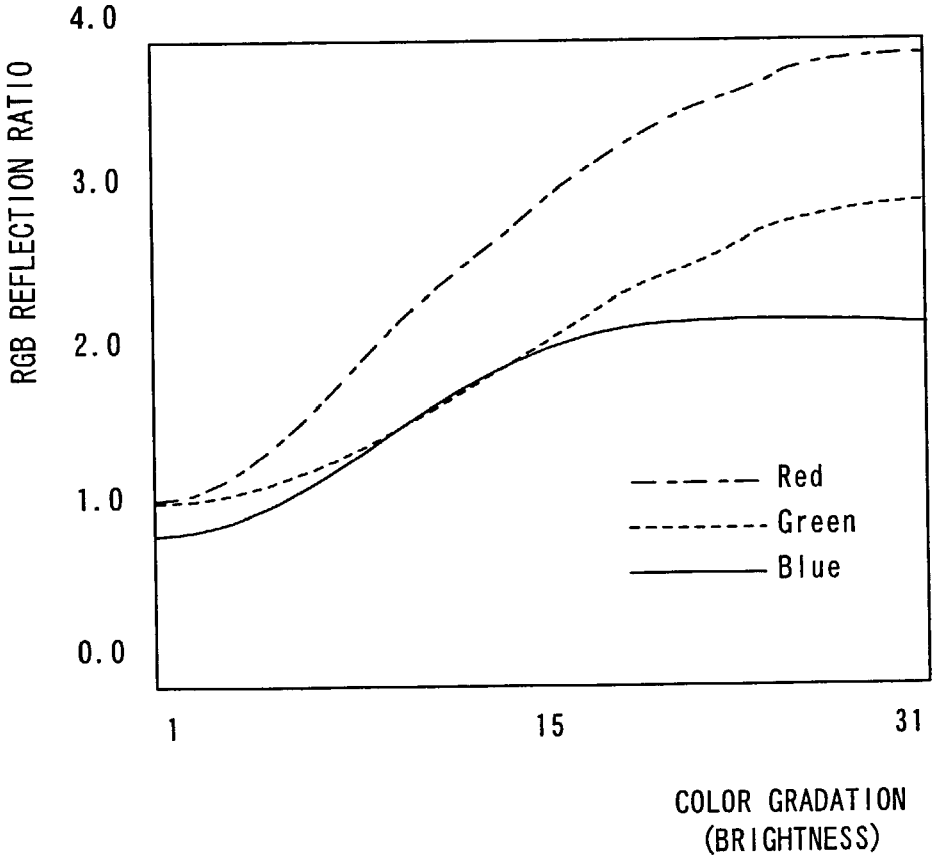
FIG. 6 is a graph showing a gradation characteristic of a color gradation with respect to an RGB reflection ratio in a reflective type crystal liquid display device.

As shown in FIG. 6, such the LCD 14 has a characteristic of a color gradation (gradation characteristic) with respect to a reflectivity of each of the R, G and B (RGB reflectivity). The gradation characteristic is empirically acquired through an examination or the like and indicates how the reflection ratio of RGB is changed by the color gradation. A following characteristic is indicated, for example, that for the color gradation of 1, R, G and B have approximately similar brightness while for the color gradation of 31, R is two times brighter than B. It is noted in this embodiment shown that the reflection ratio (changing rate) of R, G, and B in a case of making B as a reference (1) is shown in a following relation.

R:G:B=1.2:1.1:1

In view of the relation, a BG parameter and an OBJ parameter against each of color gradations (brightness) are determined. That is, the parameter is determined such that for brightening, the color gradation of R is lesser increased while the color gradation of B is more increased. On the contrary, the parameter is determined such that for darkening, the color gradation of R is more decreased while the color gradation of B is lesser decreased. Furthermore, in this embodiment, the BG parameter and the OBJ parameter, even if have the same brightness, are determined to be different values so as not to cause a disadvantage that the character is hidden under the background.

A brightness adjusting program is a program for executing a brightness adjusting process described later in detail. That is, it is a program for adjusting brightness (luminance) of the BG image and the OBJ image.

For example, in the game machine 10, the LCD 14 is illuminated utilizing sunlight or indoor light (natural light) so as to display the OBJ image and the BG image. At this time, by utilizing the above-described OBJ color data and the BG color data, the color game image can be displayed.

Specifically, a displayed color of the OBJ image and the BG image is determined by the OBJ color data and the BG color data.

In addition, in such the game machine 10, the brightness (luminance) of the LCD 14 is determined depending on brightness of the natural light, and therefore, the brightness adjusting function is not generally provided. Alternatively, even if the brightness adjusting function is provided, the LCD 14 wholly becomes light or dark, and therefore, there is a disadvantage that an outline of the OBJ image is obscure. That is, the character is hidden under the background, and therefore, it makes difficult for the user to view the game image.

For avoiding this, the brightness adjusting function is provided and brightness of the OBJ image and the BG image can be adjusted individually in this embodiment. It is noted that a default value of the brightness of the OBJ image and the BG image is determined by a designer at a step of creating the game. That is, it is determined at a programming step.

Figure 7:
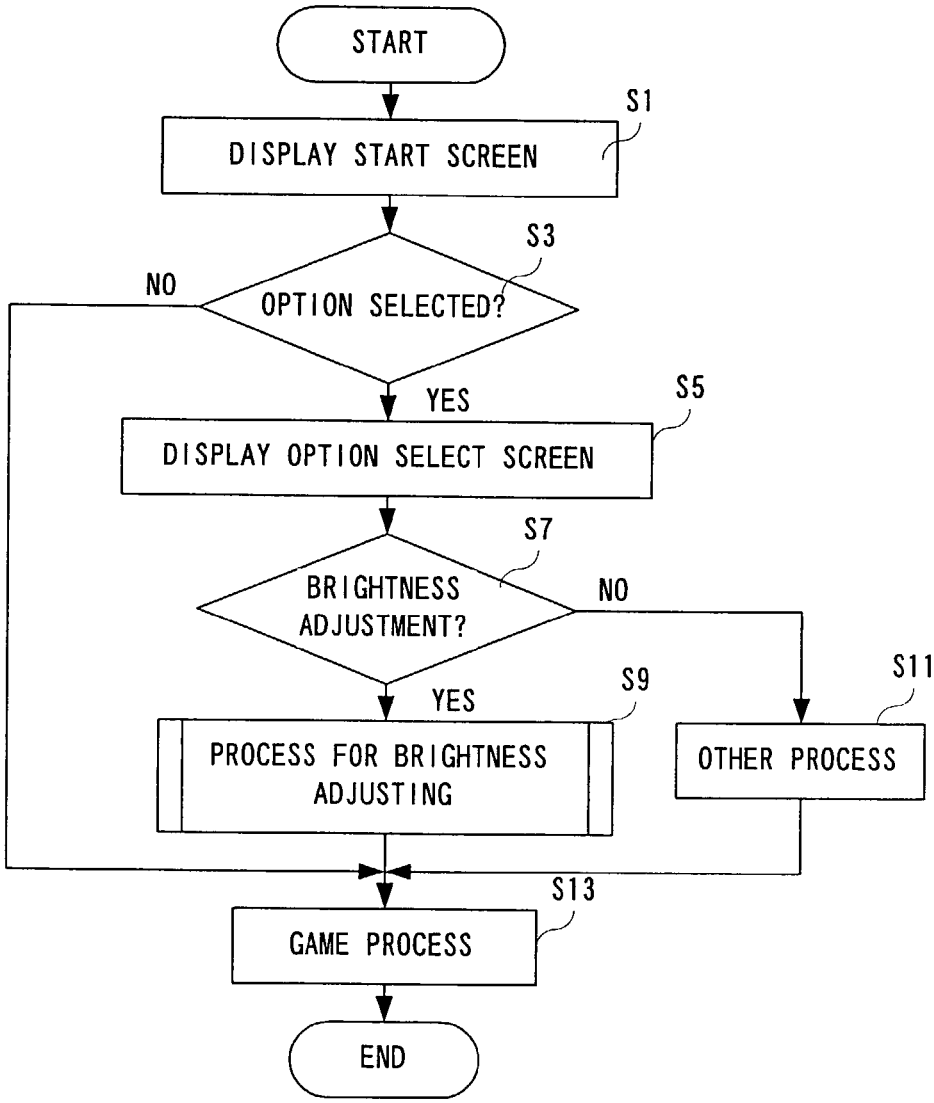
FIG. 7 is a flowchart showing a process of a CPU included in the game machine shown in FIG. 2.

A detailed operation of the game machine 10 is shown in a flowchart shown in FIG. 7. When a main power of the game machine 10 is turned on, the CPU 50 starts a process so as to display a start screen in a step S1. The start screen is displayed with letters of "NINTENDO" of a registered trademark of the assignee of the present invention, for example, and a character for selecting whether to start the game or to select an option.

In a following step S3, it is determined whether an option selection or not. For example, when a player selects a start of the game by operating a button such as a cross button 16 and etc., i.e., when "NO" is determined in the step S3, the process directly proceeds to a step S13.

On the other hand, when the player selects the option selection by operating a button such as a cross button 16 and etc., i.e., when "YES" is determined in the step S3, an option selecting screen is displayed in a step S5. Although an illustration is omitted, each of items (option) such as brightness adjustment, power source option and etc. is selectable on the option selecting screen.

Successively, it is determined whether or not an item of the brightness adjustment is selected in a step S7. Herein, if "NO" is determined, i.e., if the player selects an item different from the item of the brightness adjustment by operating a button such as the cross button 16 and etc., a process of an item such as the power source option and etc. selected (another process) is processed and then, the process proceeds to a step S13.

On the other hand, if "YES" in the step S7, the player selects the item of the brightness adjustment by operating a button such as the cross button 16 and etc., a brightness adjusting process is executed in a step S9, and then, the process proceeds to the step S13.

The CPU 50 executes a game process according to the game program in the step S13. Then, when the power source is turned off or the game is over, the process is ended. It is noted that in a case of game over, the process may be returned to the start screen.

Figure 8:
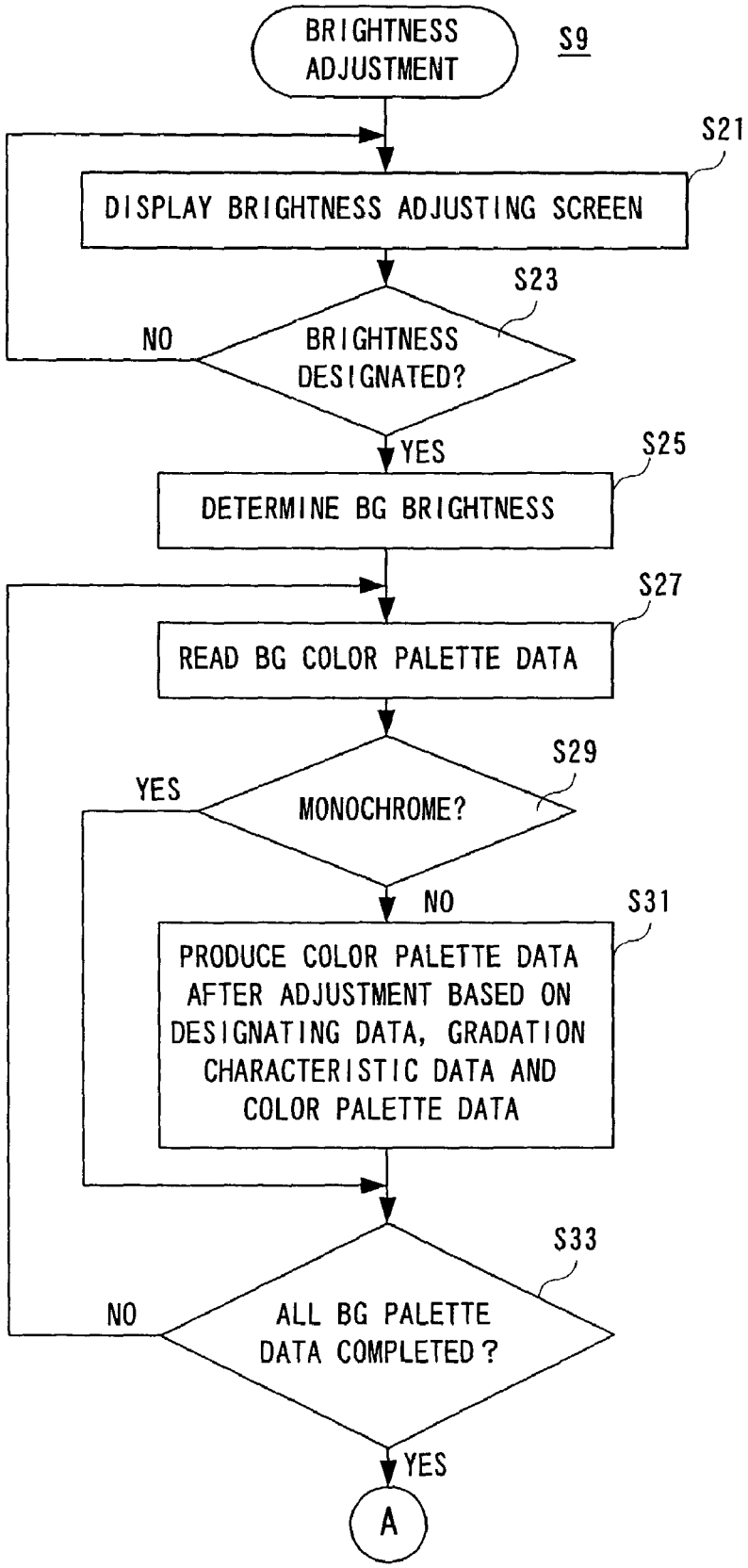
FIG. 8 is a flowchart showing a part of a brightness adjusting process of the CPU included in the game machine shown in FIG. 2.
Figure 10:
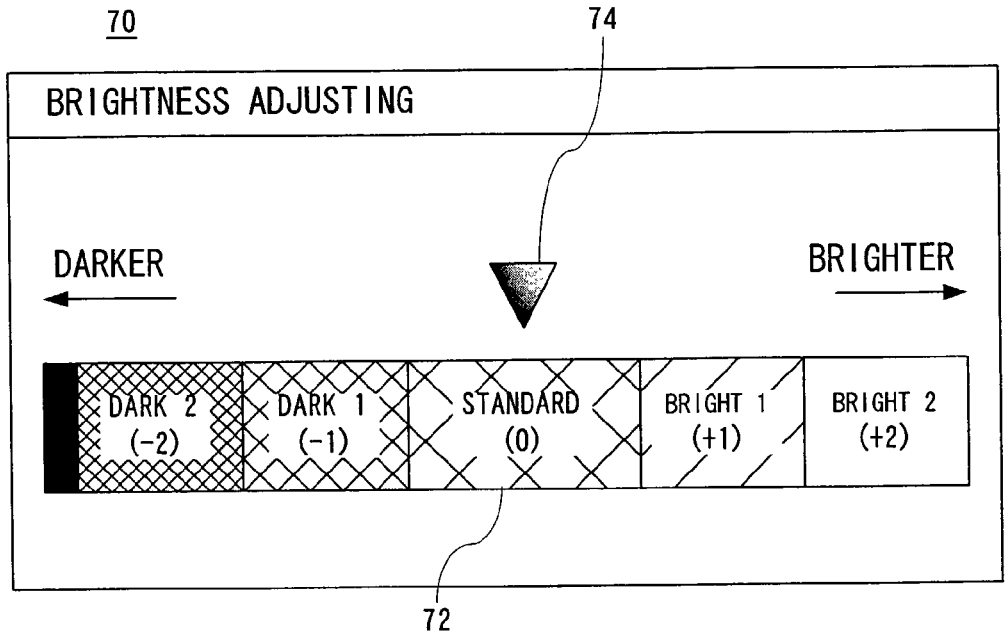
FIG. 10 is an illustrative view showing one example of a brightness adjusting screen.

Referring to FIG. 8, when the brightness adjusting process is started in the step S9, the CPU 50 activates the brightness adjusting program stored in the RAM 52 and displays a brightness adjusting screen 70 shown in FIG. 10 in a step S21. More specifically, the CPU 50 reads the brightness adjusting screen data from the ROM 60 and develops it utilizing the RAM 52 and then, displays the brightness adjusting screen 70 on the LCD 14 by applying instructions to the driver 56.

As shown in FIG. 10, in the brightness adjusting screen 70, the brightness is adjustable between two levels toward brighter direction (bright 1 (+1)), (bright 2 (+2)) and two levels toward darker direction (dark 1 (−1)), (dark 2 (−2)) making brightness determined to be optimal by a designer and etc. of the game machine 10 in advance as a standard (0). The brightness adjusting screen 70 is also provided with a luminance display portion 72 for visually recognizing the brightness by the player. The player can designate brightness from −2 to +2, i.e., in 5 levels by moving an inverted triangle mark 74 displayed on the approximately center of the screen with an operation of the cross button 16, for example.

In a following step S23, it is determined whether or not the brightness is designated. That is, it is determined whether or not the inverted triangle mark 74 on the brightness adjusting screen 70 shown in FIG. 10 is moved from side to side by operating the cross button 16. If "NO" in the step S23, i.e., if the cross button 16 is not operated, it is determined that the brightness is not designated and then, the process directly returns to the step S21.

On the other hand, if "YES" in the step S23, i.e., if the cross button 16 is operated, it is determined that the brightness is designated and then, the brightness of the BG image is determined to be the brightness indicated by the inverted triangle 74 in a step S25. Successively, each of BG color palette data is read from the BG palette in a step S27, and it is determined whether or not a color corresponding to the read BG color palette data indicates a specified color (in this embodiment, white or black) in a step S29. More specifically, the BG color palette data, i.e., each of the R, G and B data is 5 bits, and by calculating an OR (logical sum) of each of the R, G and B data, it is determined to be black for a minimum value ("00000") of the logical sum while it is determined to be white for a maximum value ("11111") of the logical sum.

It is noted that the BG color palette data is read in a predetermined order one by one in the step S27.

If "YES" in a step S29, a color corresponding to the read BG color palette data is black or white, it is determined that the brightness of the BG color palette data is not adjusted, and then, the process directly proceeds to a step S33. On the other hand, if "NO" in the step S29, i.e., if the color corresponding to the read BG color palette data is not white or black, the brightness is adjusted in a step S31. That is, adjusted BG color palette data is created on the basis of data of brightness designated by the player (designating data), gradation characteristic data and the BG color palette data. More specifically, gradation characteristic data, i.e., a BG parameter is determined in correspondence to the brightness indicated by the designating data, and by the BG parameter, BG color palette data prior adjustment is adjusted whereby, the BG color palette data is converted.

In a following step S33, it is determined whether or not conversion (adjustment) of all BG color palette data is completed. Specifically, it is determined whether or not brightness adjustment is completed as to all the colors of the BG image and renewal of the BG palette is completed. If "NO" in the step S33, i.e., if the brightness adjustment of all the colors is not completed, the process is returned to the step S27 so as to read BG color palette data corresponding to a next color.

Figure 9:
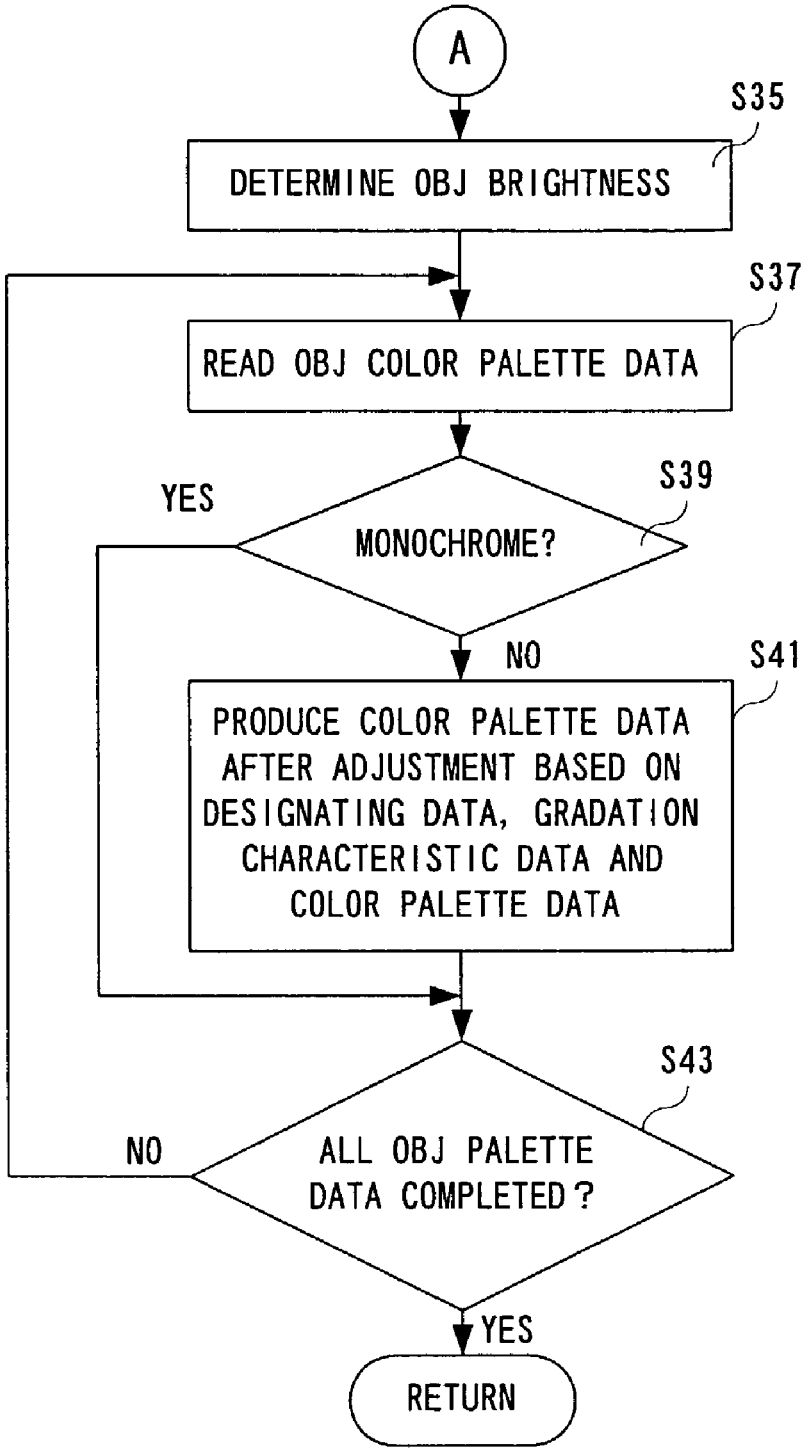
FIG. 9 is a flowchart showing another part of the brightness adjusting process of the CPU shown in FIG. 2.

On the other hand, if "YES" in the step S33, i.e., if the brightness adjustment of all the colors is completed, it is determined that the renewal of the BG palette is completed, and then, the process proceeds to a step S35 shown in FIG. 9 so as to determine the brightness of the OBJ. That is, the brightness is determined to be the brightness designated by the brightness adjusting screen 70. In a following step S37, each of OBJ color palette data is read from the OBJ palette, and it is determined whether or not the read OBJ color pallet data is white or black in a step S39.

It is noted that the OBJ color palette data is read in a predetermined order one by one in the step S37.

If "YES" in a step S39, i.e., if a color corresponding to the read OBJ color palette data is white or black, it is determined that the OBJ color palette data is not adjusted and the process directly proceeds to a step S43. On the other hand, if "NO" in the step S39, i.e., if a color corresponding to the read OBJ color palette data is different from white or black, the OBJ color palette data is adjusted on the basis of the designating data, the gradation characteristic data and the color palette data in a step S41.

It is noted that adjustment of the OBJ color palette data is the same as the case of the above-described BG color palette data except for utilizing the OBJ parameter and therefore, duplicate descriptions will be omitted.

It is determined whether or not adjustment (conversion) of all the OBJ color palette data is completed in a step S43. If "NO" in the step S43, i.e., if the adjustment of all the OBJ color palette data is not completed, the process is returned to the step S37 so as to read next OBJ color palette data. On the other hand, if "YES" in the step S43, i.e., if the adjustment of all the OBJ color palette data is completed, it is determined that renewal of the OBJ palette is completed, and the process is returned from the brightness adjusting process.

According to this embodiment, each of the GB color palette and the OBJ color palette is prepared, and color palette data included in each of the color palette is adjusted according to the brightness designated by the player, and therefore, brightness can be adjusted according to a usage environment and individual visible recognizability. Also, the brightness adjusting ratios of the GB color palette data and the OBJ color palette data are set to values different from each other, and therefore, there never occurs a disadvantage that characters are hidden under the background. Furthermore, the color palette data corresponding to the specified color (white or black) is not subject to brightness adjustment, and therefore, it is possible to prevent whitish or blackish display of the whole screen. In addition, a parameter is determined in view of the gradation characteristic, i.e., a changing rate of R, G and B, and therefore, there never occurs a change of color tone depending on the brightness.

Since the game machine 10 of another embodiment is the same as the above-described embodiment except that the brightness adjusting processes is different, duplicate descriptions will be omitted. A brightness adjusting process of this embodiment is shown in FIG. 11 and FIG. 12.

Figure 13:
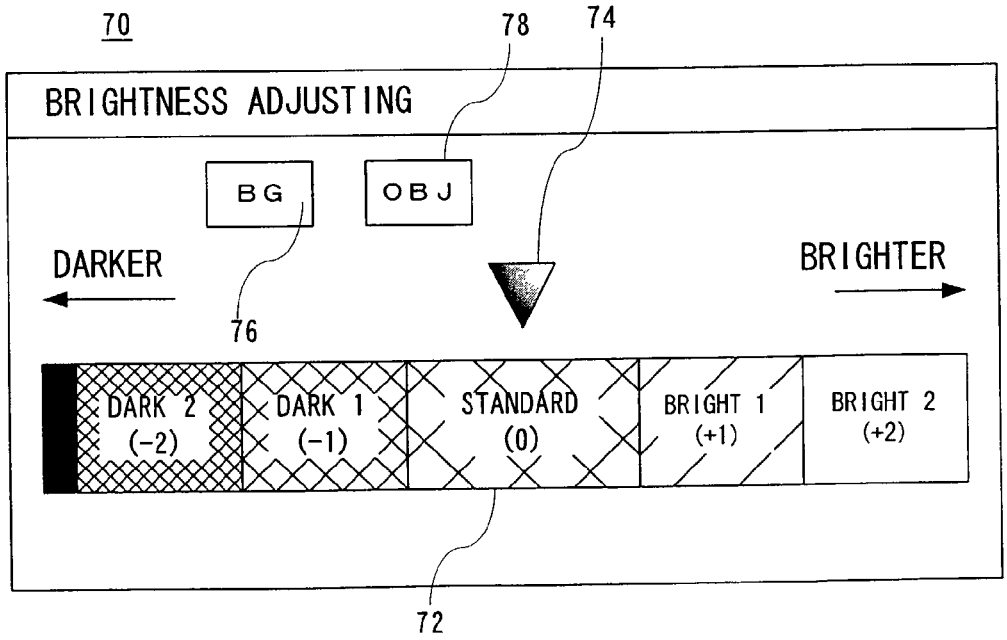
FIG. 13 is an illustrative view showing another example of the brightness adjusting screen.
Figure 11:
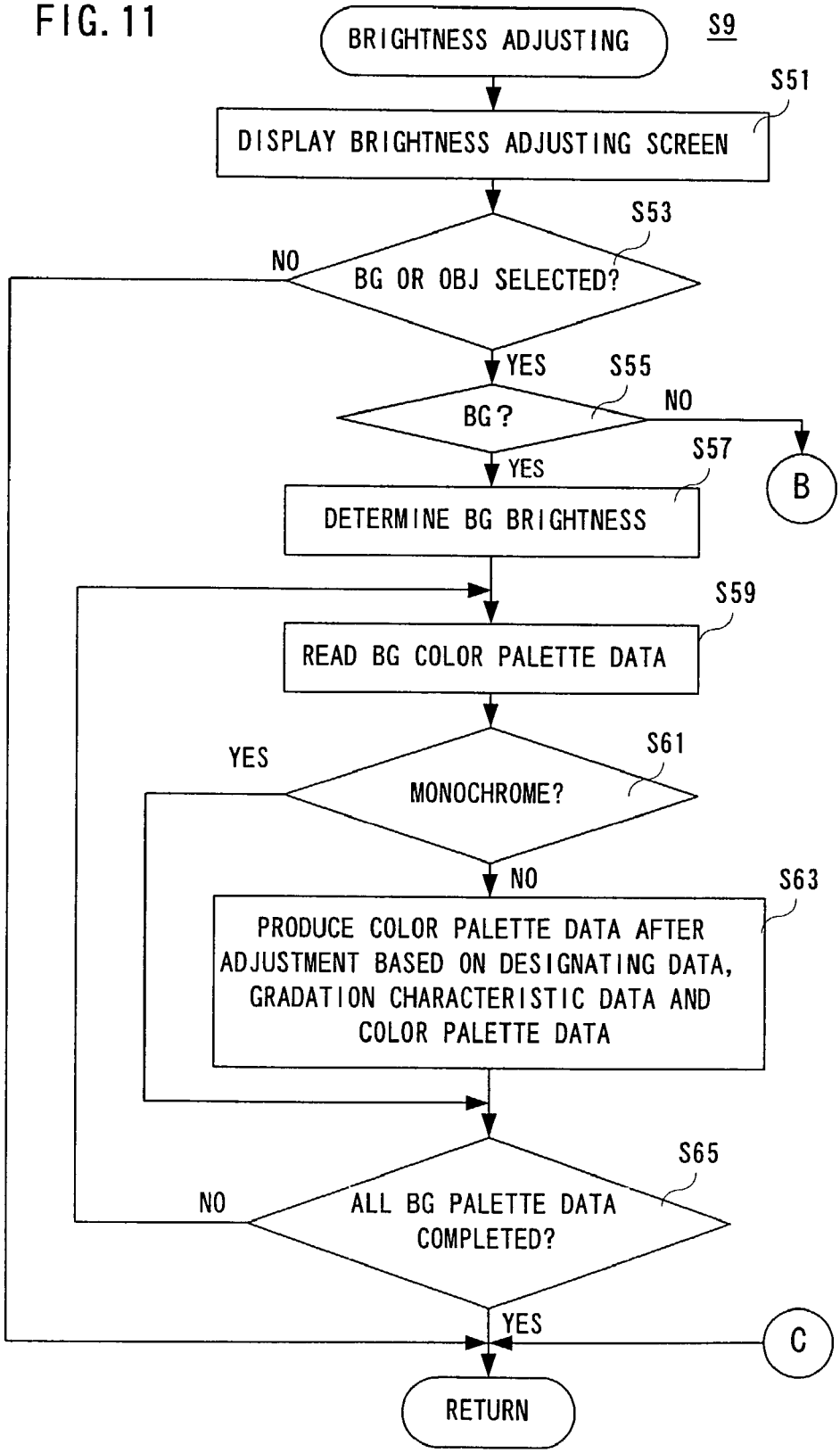
FIG. 11 is a flowchart showing a part of a brightness adjusting process of a CPU included in a game machine in another exemplary non-limiting embodiment.
Figure 12:
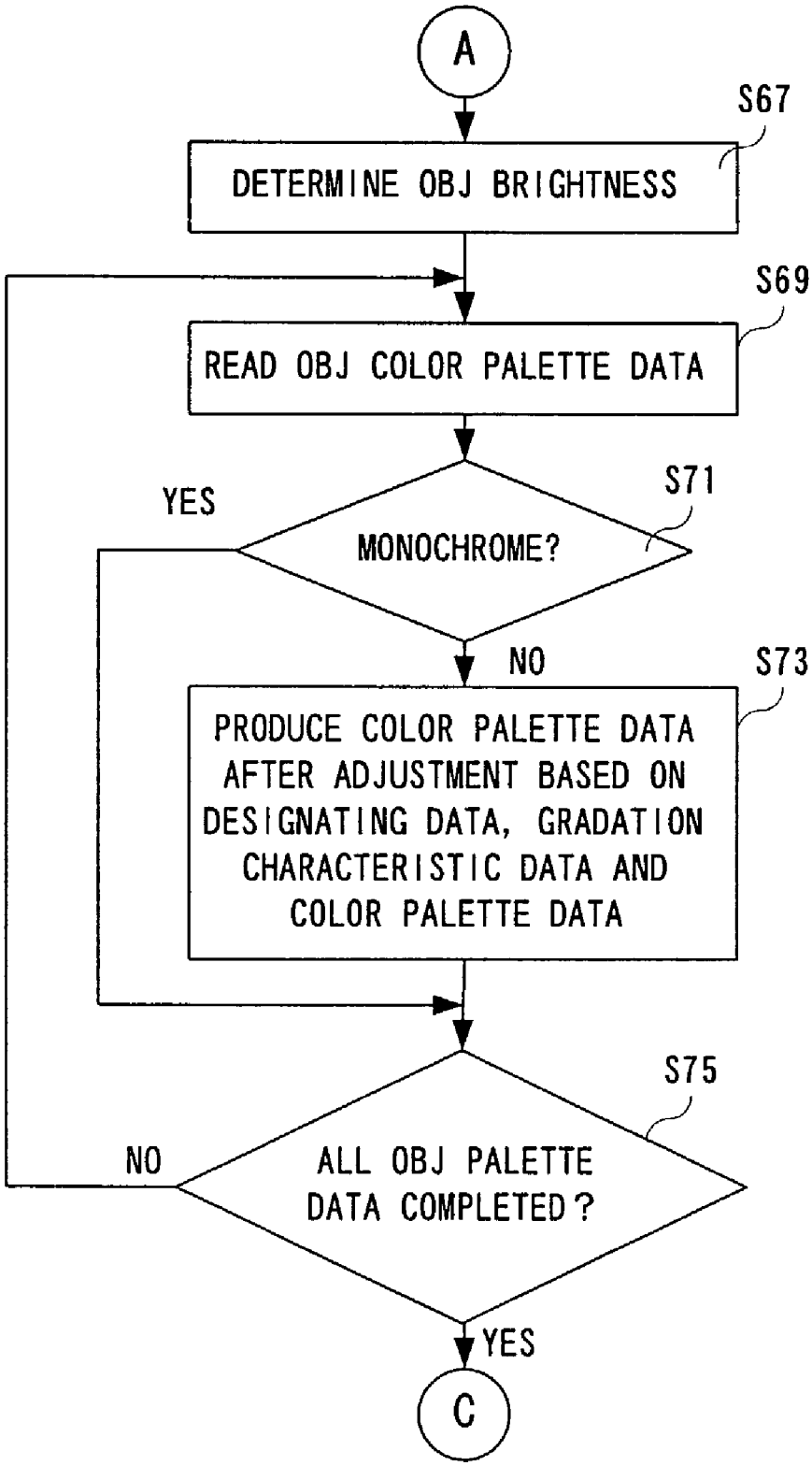
FIG. 12 is a flowchart showing another part of the brightness adjusting process of the CPU included in the game machine in another exemplary non-limiting embodiment.

Referring to FIG. 11, when the brightness adjusting process is started, the CPU 50 activates brightness adjusting program of the RAM 52 and displays the brightens adjusting screen 70 shown in FIG. 13 in a step S51. It is noted that since the brightness adjusting screen 70 in this embodiment is the same as the brightness adjusting screen 70 shown in FIG. 10 except that characters for selecting the BG or the OBJ (BG button 76 and OBJ button 78) are further provided and therefore, duplicate descriptions will be omitted. That is, the player selects (specifies) the brightness by operating the cross button 16 and selects (turns on) the BG button 76 or the OBJ button 78 by operating the A button 24 or the B button 26.

Specifically, it is determined whether or not the BG or the OBJ is selected in a step S53. If "NO" is determined in the step S53, i.e., if neither the BG nor the OBJ is selected, the process is directly returned from the brightness adjusting process.

It is noted that since it actually takes at least two or three seconds by the time the A button 24 or the B button 26 is operated, in a case neither button is operated after five seconds' wait, the process may be returned from the brightness adjusting process.

On the other hand, if "YES" in the step S53, i.e., if the BG or the OBJ is selected, it is determined whether or not the "BG" is selected in a step S55. If "NO" is determined in the step S55, i.e., if the OBJ is selected, the process proceeds to a step S67 shown in FIG. 12. On the other hand, if "YES" in a step S57, i.e., if the BG is selected, the brightness of the BG is determined to brightness currently indicated by the inverted triangle mark 74 on the brightness adjusting screen 70 in the step S57.

In a following step S59, each of the BG color palette data is read from the BG palette. It is determined whether a color corresponding to the read BG color palette data is white or black in a step S61. If "YES" is determined in the step S61, i.e., if the read BG color palette data is white or black, it is determined that the brightness of the BG color palette data is not adjusted, and the process directly proceeds to a step S65.

On the other hand, if "NO" is determined in the step S61, i.e., if the read BG color palette data is a color other than white or black, the brightness of the BG color palette data is adjusted in a step S63, and then, the process proceeds to the step S65. It is determined whether or not adjustment of all the BG color palette data is completed in the step S65.

If "NO" is determined in the step S65, i.e., if adjustment of all the BG color palette data is not completed, the process returns to the step S59 so as to read next color palette data. On the other hand, if "YES" in the step S65, i.e., if adjustment of all the BG color palette data is completed, it is determined that renewal of the BG palette is completed, and then, the process is returned from the brightness adjusting process.

Referring to FIG. 12, the brightness of the OBJ image is determined to be the brightness currently indicated by the inverted triangle 74 on the brightness adjusting screen 70 in the step S67. In a following step S69, each of the OBJ color palette data is read from the OBJ palette, and it is determined that whether a color corresponding to the read OBJ color palette data is white or black in a step S71. If "YES" in the step S71, i.e., if the read OBJ color palette data is white or black, it is determined the OBJ color palette data is not adjusted, and then, the process directly proceeds to a step S73. On the other hand, if "NO" in the step S71, i.e., if the read OBJ color palette data is a color other than white or black, the brightness of the OBJ color palette data is adjusted in the step S73, and then, the process proceeds to a step S75.

It is determined whether or not adjustment (conversion) of all the OBJ color palette data is completed in the step S75. If "NO" in the step S75, i.e., if adjustment of all the OBJ color palette data is not completed, the process returns to the step S69 so as to read next OBJ color palette data. On the other hand, if "YES" in the step S75, i.e., if adjustment of all the BG color palette data is completed, it is determined that renewal of the OBJ palette is completed, and then, the brightness adjusting process is completed.

Thus, it is possible to individually adjust the brightness of the BG image and OBJ image according to this embodiment.

It is noted that although the BG button or the OBJ button is provided on the brightness adjusting screen so as to adjust either of the BG or the OBJ in the above-described embodiment, both of the buttons may be provided so as to adjust both of the BG and the OBJ. In this case, the BG button, the OBJ button or both buttons are determined, and when both of the buttons are selected (turned on) on the brightness adjusting screen, the brightness adjusting process shown in the previously described embodiment may be executed.

Although a memory cartridge is necessarily attached to the game machine in these embodiments, and the brightness adjusting program and the brightness adjusting screen data are stored in the ROM within the memory cartridge, these may be stored in advance in the RAM within the game machine. Alternatively, a further ROM (internal ROM) may be provided within the game machine so as to store the program and the data.

Furthermore, although the brightness adjustment is not performed on a specified color such as white and black in these embodiments, the specified color is not limited to white and black, and another color may be appropriate.

In addition, although description is made on only the game machine provided with the brightness adjusting apparatus of the LCD, it is needless to say that the exemplary non-limiting embodiments can be applied to a portable communication terminal such as a PDA.

Although exemplary non-limiting embodiments has been described and illustrated in detail, it is clearly understood that the same is by way of illustration and example only and is not to be taken by way of limitation, the spirit and scope of the present invention being limited only by the terms of the appended claims.

What is claimed is:

1. A brightness adjusting apparatus of a reflective type liquid crystal display device for determining a displayed color on the basis of color data of a color palette, comprising:

a character color palette for storing a plurality of first color data to display a character;

a background color palette for storing a plurality of second color data to display a background;

a brightness determining device for determining brightness of at least one of said character and said background; and a renewal device for renewing at least one of said character color palette and said background color palette on the basis of an adjustment value corresponding to the brightness determined by said brightness determining device, the adjustment value being determined based on received user input relating to brightness.

2. An apparatus according to claim 1, wherein said brightness determining device includes a first determination device for determining brightness of said character, and said renewal device includes a first renewal device for renewing said character color palette by converting said plurality of first color data with a first adjustment value corresponding to the brightness determined by said first determination device, the first adjustment value being determined based on the user input relating to brightness.

3. An apparatus according to claim 2, wherein said brightness determining device includes a second determination device for determining brightness of said background, and said renewal device includes a second renewal device for renewing said background color palette by converting said plurality of second color data with a second adjustment value corresponding to the brightness determined by said second determination device, the second adjustment value being determined based on the user input relating to brightness.

4. An apparatus according to claim 3, wherein said first adjustment value and said second adjustment value are determined as values different from each other based on the same user input relating to brightness.

5. An apparatus according to claim 4, further comprising a detector for detecting said first color data and said second color data corresponding to a specified color, wherein said first renewal device and said second renewal device renew said character color palette and said background color palette by converting said first color data and said second color data except for the first color data and the second color data corresponding to said specified color.

6. An apparatus according to claim 1, wherein said brightness determining device includes a first determination device for determining brightness of said background, and said renewal device includes a first renewal device for renewing said background color palette by converting said plurality of first color data with a first adjustment value corresponding to the brightness determined by said first determination device, the first adjustment value being determined based on the user input relating to brightness.

7. An apparatus according to claim 1, wherein said adjustment value is determined on the basis of a gradation characteristic of color.

8. A brightness adjusting apparatus of a reflective type liquid crystal display device for determining a displayed color on the basis of color data of a color palette, comprising:

a brightness determining device for determining brightness;

a detector for detecting said color data corresponding to a specified color; and a renewal device for renewing said color palette by converting said color data except for the color data corresponding to said specified color with an adjustment value corresponding to the brightness determined by the brightness determining device.

9. An apparatus according to claim 8, wherein said color palette includes a character color palette including a plurality of first color data for displaying a character, and said renewal device includes a first renewal device for renewing the character color palette by converting said first color data except for the first color data corresponding to said specified color with a first adjustment value corresponding to the brightness determined by said brightness determining device.

10. The apparatus as in claim 9, wherein the first adjustment value corresponding to the brightness determined by the brightness determining device is determined based at least on user input relating to brightness.

11. An apparatus according to claim 8, wherein said color palette includes a background color palette including a plurality of first color data for displaying the background, and said renewal device includes a first renewal device for renewing said background color palette by converting said first color data except for the first color data corresponding to said specified color with a first adjustment value corresponding to the brightness determined by said brightness determining device.

12. The apparatus as in claim 11, wherein the first adjustment value corresponding to the brightness determined by the brightness determining device is determined based at least on user input relating to brightness.

13. The apparatus as in claim 8, wherein the adjustment value corresponding to the brightness determined by the brightness determining device is determined based at least on user input relating to brightness.

14. A program stored in a computer readable medium for a game machine provided with a game program executed by a processor so as to allow a character and a background to be displayed on a reflective type liquid crystal display device by utilizing a character color palette storing a plurality of first color data and a background color palette for storing a plurality of second color data, the program making said processor execute following steps:

a display step for displaying a brightness adjusting screen for enabling user input for adjusting brightness; and a renewal step for renewing at least one of said character color palette and said background color palette on the basis of an adjustment value corresponding to brightness of at least one of said character and said background determined from said user input received in connection with said brightness adjusting screen.

15. A program stored in a computer readable medium for a game machine provided with a game program for determining a displayed color of a reflective type liquid crystal display device so as to execute a game by a processor utilizing a color palette storing a plurality of color data, the game program making said processor execute following steps:

a display step for displaying a brightness adjusting screen;

a detecting step for detecting said color data corresponding to a specified color; and a renewal step for renewing said color palette by converting said color data except for the color data corresponding to said specified color with an adjustment value corresponding to the brightness determined by said brightness adjusting screen.

16. The program as in claim 15, wherein the brightness adjusting screen enables user input for adjusting brightness to be received.

17. In a video game, a method of adjusting brightness of at least one image of the video game, the method comprising:

storing color palette data corresponding to the at least one image;

generating a brightness adjusting screen for enabling user input for adjusting brightness;

receiving user input for adjusting brightness in response to the brightness adjusting screen; and changing the color palette data corresponding to the at least one image based on the received user input.

18. The method of claim 17, wherein generation of the brightness adjusting screen is initiated by receipt of a user instruction requesting brightness adjustment.

19. The method of claim 17, wherein the at least one image is a character image.

20. The method of claim 19, wherein the brightness adjusting screen includes a button for user selection which enables individual brightness adjustment of the character image.

21. The method of claim 17, wherein the at least one image is a background image.

22. The method of claim 21, wherein the brightness adjusting screen includes a button for user selection which enables individual brightness adjustment of the background image.

23. The method of claim 17 wherein the at least one image includes a character image and a background image and the brightness adjusting screen includes a first button for user selection which enables brightness adjustment of the character image and a second button for user selection which enables brightness adjustment of the background image.

24. The method of claim 23 wherein the user input in response to the brightness adjusting screen includes user selection of both the first and second buttons.

25. The method of claim 17 further comprising displaying the at least one image on a reflective type liquid crystal display of a hand-held game machine.

26. In a video game, a method of adjusting brightness of an image to be displayed in the video game, the method comprising:

storing color palette data corresponding to the image;

receiving user input indicating an adjustment to the brightness of the image;

determining whether or not the color palette data corresponding to the image corresponds to a specified color; and preventing brightness adjustment of the image if the color palette data corresponding to the image corresponds to the specified color and allowing brightness adjustment of the image based on the received user input if the color palette data corresponding to the image does not correspond to the specified color.

27. The method of claim 26, wherein the specified color is black or white.

28. The method of claim 26, wherein the color palette data is character color palette data.

29. The method of claim 26 wherein the color palette data is background color palette data.

30. The method of claim 26 further comprising displaying the image on a reflective type liquid crystal display of a handheld game machine.

* * * * *